United States Patent [19]

Zangrando

[11] 4,112,267

[45] Sep. 5, 1978

[54] CODED SWITCHING DEVICE

[75] Inventor: Roy A. Zangrando, Lake Hiawatha, N.J.

[73] Assignee: The United States of America as represented by the Secretary of the Army, Washington, D.C.

[21] Appl. No.: 715,278

[22] Filed: Aug. 18, 1976

[51] Int. Cl.[2] ..... H01H 27/06

[52] U.S. Cl. ..... 200/43; 176/45; 70/278

[58] Field of Search ..... 200/42 R, 43, 44, 45; 317/134; 70/278

[56] References Cited

U.S. PATENT DOCUMENTS

| | | | |
|---|---|---|---|
| 1,315,182 | 9/1919 | Davis | 200/43 |
| 1,519,303 | 12/1924 | Gross et al. | 200/43 |
| 2,806,911 | 9/1957 | Harty et al. | 200/43 |
| 3,723,678 | 3/1973 | Heap | 200/44 |

*Primary Examiner*—Samuel W. Engle
*Assistant Examiner*—Ralph Palo
*Attorney, Agent, or Firm*—Nathan Edelberg; Harold H. Card, Jr.; A. Victor Erkkila

[57] ABSTRACT

A coded switching device having a plurality of actuator dial knobs will, when set to a predetermined combination, provide electrical continuity between terminals on the device. Setting the dial knobs to another predetermined combination will enable the combination to be changed. The device consists of a number of stations, each comprising an actuator, a switch, and a detent mechanism, equal to the number of digits desired in the combination. Each switch is wired such that only one position will provide continuity through that switch. The switch rotors are connected to the actuators in a manner which will allow their angular relationship, and hence, the particular combination which will close all switches, to be changed by withdrawing the dial knobs in a direction outward from the device. A grooved rod extending transverse to the actuators gangs all of the actuators together for this combination change movement. Additionally, this rod restrains the switch rotors from angular rotation until the dial knobs are depressed and the actuators re-engaged with the switches.

9 Claims, 7 Drawing Figures

CODED SWITCHING DEVICE

GOVERNMENTAL INTEREST

The invention described herein may be manufactured, used, and licensed by or for the Government for Governmental purposes without the payment to me of any royalties thereon.

BACKGROUND OF THE INVENTION

The need for administrative control on military devices has prompted the use of combination locks and physically controlled links such as keys, shorting plugs, code plugs, and the like. The use of physical links is undesirable due to the possibility of loss and difficulty of transfer and code change. These factors are eliminated through the use of combination lock devices; however, in many applications, the latter are designed for higher security measures and are excessively complex for the application. There exists, therefore, the need for a simple coded switching device featuring a simple, self-contained combination change capability which can be applied to restrict the use of an electronic device or of any particular function contained thereon.

SUMMARY OF THE INVENTION

The present invention relates to a coded switching device having a changeable code which provides an electrical switch closure when set to the proper combination. A number of rotatable actuators and switches are relatively movable axially, under the control of mutual detent means, to engage and disengage respective actuators and switch rotors, thereby permitting a variation in their angular relationship. Such relationship, once established, determines the combination necessary to close all of the switches. Subsequent disengagement is precluded until a different combination is set.

An object of the present invention is to provide an improved means for administrative control of electrical devices or functions.

Another object of the present invention is to provide a simple means for changing the combination needed to operate the device.

Another object of the present invention is to permit changing the combination without the need for physical tools.

A further object of the present invention is to provide a coded switching device which is simple to manufacture and can be produced at a relatively low cost.

For a better understanding of the present invention, reference is made to the following description taken in connection with the accompanying drawings.

BRIEF DESCRIPTION OF THE DRAWINGS

Throughout the following description, like reference numerals are used to denote like parts of the drawings.

DETAILED DESCRIPTION OF THE PREFERRED EMBODIMENT

Figure 1:
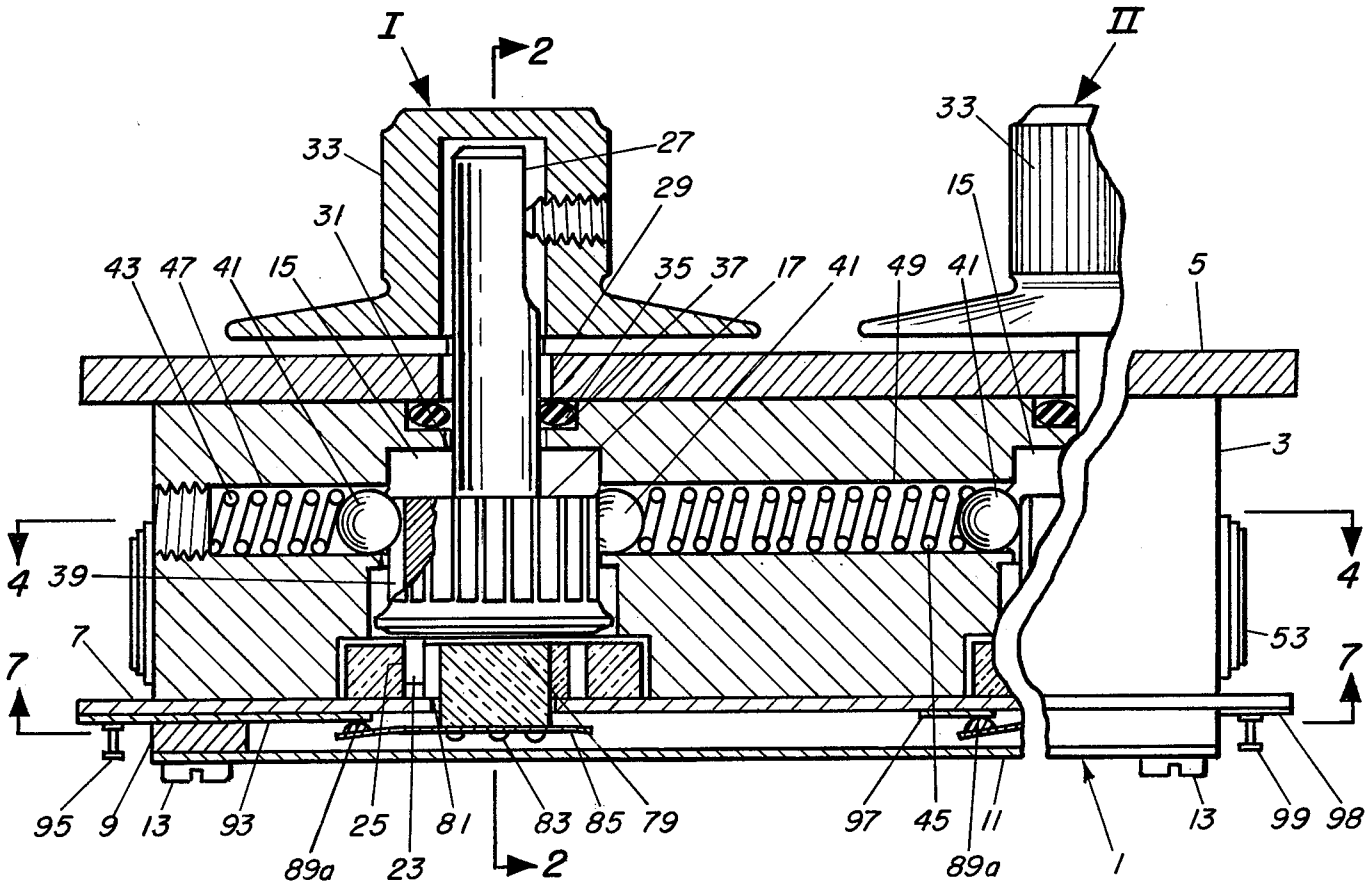
FIG. 1 is a side view of a switching device incorporating the invention, in the normal or closed-circuit position, partly in section along line 1—1 of FIG. 4.

Referring to the drawings, the coded switching device 1 comprises an elongated body 3 having a top plate or panel 5, attached thereto by any suitable means. On the bottom side of body 3, in order, an insulating board 7, a hollow spacer 9, and an insulating cover plate 11 are mounted by screws 13. The body 3 is formed with a series of cavities 15, each containing a detent wheel 17 and a rotor 19 coaxial with each other and both rotatable in the cavity. The rotor 19 is seated in a counterbore 21 and rests on the board 7. Each detent wheel 17 is located above a rotor 19, and rests thereon in one position thereof with an eccentric pin 23 on the wheel extending into one of a series of holes 25 (e.g. 10) in the rotor. An integral central shaft 27 on each detent wheel 17 extends upwardly through holes 29 and 31 in the body 3 and panel 5, respectively. A dial knob 33, having a dial 34, is attached to the projection of each shaft 27 to provide means for rotating and/or axially sliding the detent wheel 17. Preferably, the space between the shaft 27 and body 3 is sealed with a moisture O-ring 35 mounted in an annular recess 37 in body 3.

Figure 4:
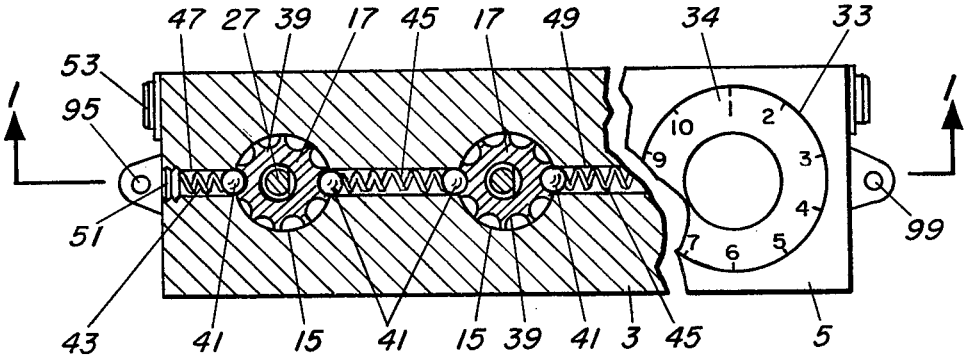
FIG. 4 is a partial cross-section taken along line 4—4 of FIG. 1.

In order to releasably hold each detent wheel 17 in any one of its rotary positions corresponding to the rotor holes 25, each detent wheel 17 is formed with longitudinal detent grooves 39 (see FIGS. 1 and 4) into two of which two detent balls 41 are urged by coil springs 43 and 45 which are mounted in bores 47 and 49 in the body 3, closed by threaded plugs 51 (one shown).

Figure 2:
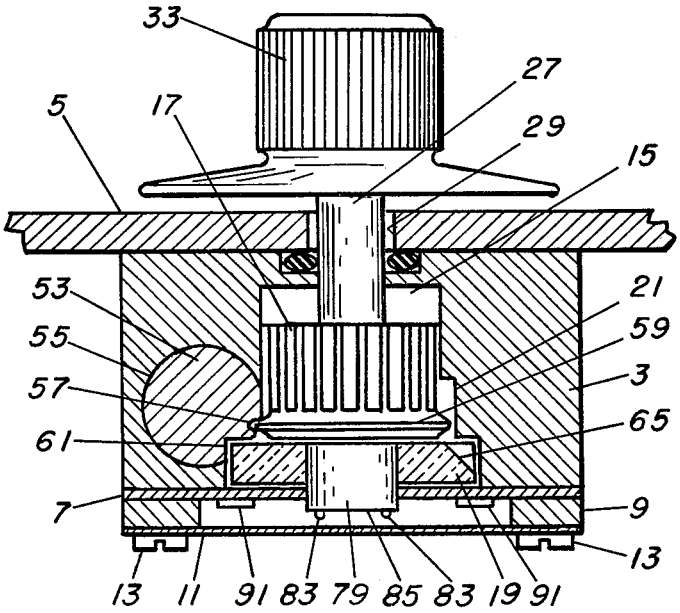
FIG. 2 is a cross-section taken along line 2—2 of FIG. 1.
Figure 3:
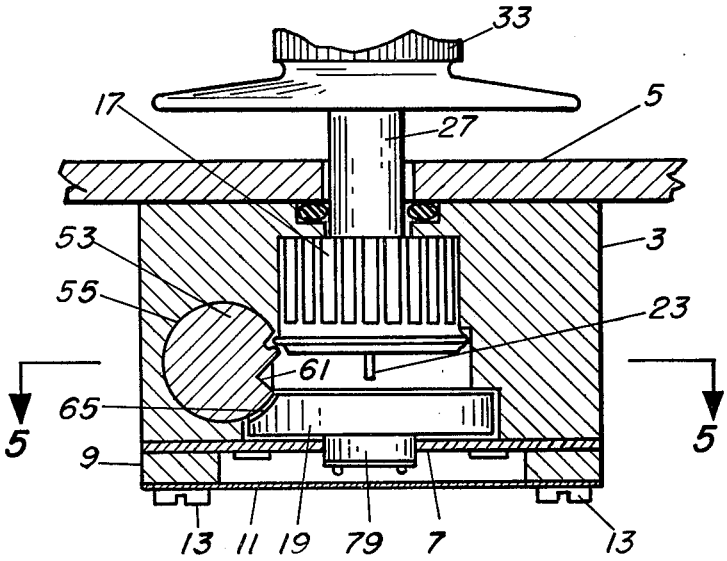
FIG. 3 is a cross-section similar to that of FIG. 2 but in the combination-change position.
Figure 5:
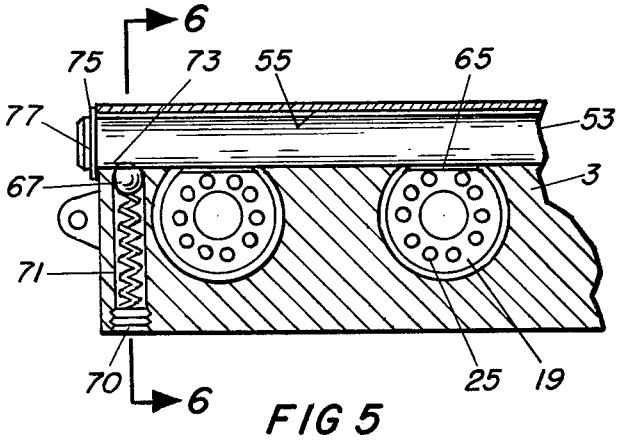
FIG. 5 is a partial cross-section taken along line 5—5 of FIG. 3, rotated 90° clockwise.
Figure 6:
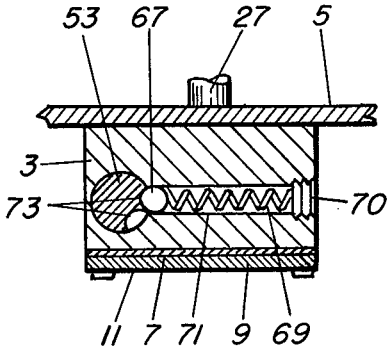
FIG. 6 is a cross-section taken along line 6—6 of FIG. 5.

In FIGS. 1 and 2, the detent wheel 17 is shown in its lower position, in which the pin 23 projects into one of the rotor holes 25, while FIG. 3 shows the detent wheel 17 in its upper position, freeing the rotor 19 from the pin 23. All of the detent wheels 17 in the switch 1 are held in the lower position in FIG. 2 by means of a transverse locking rod 53, rotatably mounted in an elongated bore 55 in the body 3. A first longitudinal groove 57 on rod 53 engages a peripheral ridge 59 on the lower end of each detent wheel 17 at all times, thus ganging the rod and wheels together for simultaneous rotary motion of the rod and axial movement of the detent wheel 17. A second longitudinal groove 61 on rod 53 engages the upper edge 63 of each rotor 19, as shown in FIG. 2, in all rotary positions except one thereof, to lock the rod 53 against rotation, which locks all the detent wheels 17 against upward motion. Each rotor 19 has a flat 65 on one edge, at one of the ten positions, which releases the groove 61 and rod 53 when all of the rotors are rotated to the position shown in FIG. 3, thus permitting the detent wheels 17 to be moved up and down by one of the knobs 33. The rod 53 is releasably held in either of its two rotary positions by means of a detent ball 67, a coil spring 69, and a plug 70, mounted in a bore 71 in body 3, and two elongated grooves 73 on the rod 53, into one of which the ball 67 extends (FIGS. 5 and 6).

Concentric with each rotor 19 and attached thereto is an insulating hub 79, which extends through a hole 81 in the insulating board 7. Attached to the lower end of each hub 79, as by rivets 83, is a double-ended conductive wiper element 85 having two arms 87 with contacts 89 which simultaneously contact, and connect together, two segments of an annular series of 10 spaced contact segments 91, mounted on the bottom surface of insulating board 7, in axial alignment with the rotor holes 25.

Figure 7:
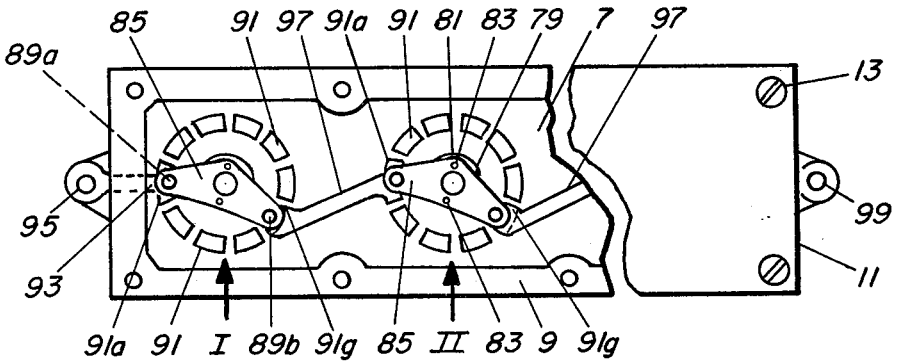
FIG. 7 is a cross-section taken along line 7—7 of FIG. 1.

The switch 1 may include any number of stations (e.g. five) identified as I, II, etc., starting at the left end in FIGS. 1 and 7, each including a detent wheel 17, a rotor 19, a wiper element 85, and a series of contact segments 91. One segment 91*a* (e.g. number "1") of the first station I is connected by a conductive extension 93 to an external terminal 95. One segment 91*g* (e.g. number "7") of each station except the last is connected by a connector 97 to the first segment 91*a* of the next station. Segment 91*g* of the last station is connected by a connector 98 to an external output terminal 99. In the position shown in FIGS. 2 and 7, the contacts 89*a* and 89*b* of each wiper element 85 are in contact with segments 91*a* and 91*g*, thus completing an electrical path through the switch 1, between terminals 95 and 99. The spacer 9 and cover plate 11 form a protective enclosure for the wiper element 95, segments 91 and connectors 97.

The position shown in FIGS. 1, 2 and 7 is the "normal" or "closed-circuit" position. The switch is opened, and hence, the combination switch is locked, by rotating one or more of the knobs 33 at least one step in either direction, thereby disconnecting wiper contacts 89*a* and 89*b* from segments 91*a* and 91*g*. Subsequent closing of the switch requires a knowledge of the code or combination to which the switch has been set, that is, the correct rotary positions of all of the dial knobs 33 to produce the condition shown in FIG. 7.

If it is desired to change the combination, any (or all) of the dial knobs 33 is rotated from the normal position shown in FIG. 2 to a predetermined combination change position shown in FIG. 3, thus moving the flat 65 to face the rod 53. In this position, the rotor edge 63 is displaced from the groove 61 of rod 53, so the rod is free to rotate. Now, the detent wheel 17 can be raised by means of the knob 33, disengaging pin 23 from rotor hole 25. This movement of detent wheel 17 rotates rod 53 to the position of FIG. 3, wherein rotation of the rotor is prevented by engagement of the flat 65 with the rod 53. The lock combination is changed by rotating the detent wheel 17 to position its pin 23 above a different selected rotor hole 25, and hence, produce a different angular relationship between the detent wheel 17 and the rotor 19.

To prevent inadvertent combination change during a normal access opertion, the combination change position is preferably displaced from that which closes the circuit between terminals 95 and 99. In the example disclosed, the combination change position is displaced 180° from the normal position, to simplify illustration only, but any other displacement may be used.

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

What is claimed is:

1. A coded switching device comprising at least one switch, each switch including:

stationary contact means;

rotatable contact means having a fixed number of angular orientations, in only one of which said contact means completes an electrical path through said switch;

rotatable actuating means coaxial with said rotatable contact means and including indicia means for indicating its angular orientation;

means for selectively engaging said actuating means with said rotatable contact means in any angular relation thereto; said actuating means being disengagable from said rotatable contact means to permit changing said angular rotation; and means for preventing said disengagement unless said rotatable contact means is in a particular angular orientation.

2. A switching device as in claim 1, wherein said particular orientation is different from said one orientation, to avoid inadvertent combination change during normal switch operation.

3. A switching device as in claim 1, further comprising resilient detent means for releasably holding said actuating means in any selected orientation, wherein said detent means comprises:

a detent wheel, coaxially carried by said actuating means, having a number of periphery longitudinal grooves equal to said number of angular orientations;

at least one detent ball engageable with one of said grooves; and spring means biasing said ball towards said groove.

4. A switching device as in claim 1, wherein:

said stationary contact means comprises a circular array of contact segments coaxial with the axis of rotation of said rotatable contact means;

said rotatable contact means comprises a double-ended switch arm having two contacts engageable in each of said angular orientations with two of said contact segments; and means connecting the two segments engaged by said switch arm contacts in said one angular orientation to two external terminals.

5. A switching device as in claim 1, wherein:

said movable contact means comprises a disc-shaped rotor;

said actuating means comprises a cylindrical member mounted for axial as well as rotary motion relative to said rotor; and said engaging means comprises a number of axial holes, equal to said number of angular orientations, disposed in a circle coaxial with said rotor, and an eccentric axial pin on said cylindrical member engageable with any one of said axial holes.

6. A switching device as in claim 5, wherein:

said disengagement preventing means comprises:

a peripheral ridge on said cylindrical member;

a locking rod mounted adjacent to said rotor and said rib for rotation about an axis perpendicular to and radially spaced from the axis of rotation of said rotor and said cylindrical member, between two angular positions, said rod having a first longitudinal groove engageable with said rib in both of said positions, and a second longitudinal groove which engages a peripheral portion of said rotor in all except one angular orientation thereof and in the position of said rod wherein said cylindrical member is engaged with said rotor;

a flat on said peripheral rotor portion, at one angular orientation thereof, located adjacent to said rod but out of path of said second groove, thereby permitting rotary motion of said rod and axial motion of said cylindrical member to withdraw said pin from said hole and change said angular relation, while preventing rotary motion of said rotor.

7. A switching device as in claim 6, wherein said disengagement preventing means further comprises resilient detent means for releasably holding said rod in either of said two positions.

8. A coded switching device as in claim 1, comprising a plurality of said switches, wherein the stationary contact means of adjacent switches are connected together to form a continuous electrical path through all of the switches when all of said rotatable contact means are in said one angular orientation.

9. A coded switching device as in claim 8, wherein said disengagement preventing means of all of the switches are ganged together to prevent axial disengagement of any of said actuating means from said rotatable contact means unless all of said rotatable contact means are in said particular angular orientation.

* * * * *